US006508255B1

(12) United States Patent
Glover et al.

(10) Patent No.: US 6,508,255 B1
(45) Date of Patent: Jan. 21, 2003

(54) EYELINER APPLICATOR

(75) Inventors: Angela Glover, Coram, NY (US); Jonathan Thayer, North Bergen, NJ (US)

(73) Assignee: Color Access, Inc., Melville, NY (US)

( * ) Notice: Subject to any disclaimer, the term of this patent is extended or adjusted under 35 U.S.C. 154(b) by 0 days.

(21) Appl. No.: 09/696,140

(22) Filed: Oct. 25, 2000

(51) Int. Cl.[7] ..... A45D 40/30
(52) U.S. Cl. ..... 132/216
(58) Field of Search ..... 132/200, 216, 132/218, 317, 318; 401/123, 128, 292

(56) References Cited

U.S. PATENT DOCUMENTS

| | | | | | |
|---|---|---|---|---|---|
| 1,533,664 | A | * | 4/1925 | Sanford | 132/73 |
| 1,569,083 | A | * | 1/1926 | Frey | 132/73 |
| 1,795,482 | A | * | 3/1931 | Ehmann | 132/216 |
| 2,323,595 | A | * | 7/1943 | Hanisch | 132/216 |
| 2,675,004 | A | * | 4/1954 | Bablon | 132/218 |
| 2,998,821 | A | * | 9/1961 | Hurdel | 132/216 |
| 3,516,423 | A | | 6/1970 | Seidler | 132/88.7 |
| 3,908,678 | A | | 9/1975 | Conn et al. | 132/92 A |
| 4,006,750 | A | | 2/1977 | Chodorow | 132/91 |
| 4,527,575 | A | * | 7/1985 | Vasas | 132/218 |
| 4,691,719 | A | | 9/1987 | Ciccarelli | 132/92 R |
| 4,790,336 | A | | 12/1988 | Kuo | 132/325 |
| 5,060,681 | A | | 10/1991 | Westbrook et al. | 132/325 |
| 5,246,021 | A | | 9/1993 | Katz | 132/323 |
| 5,560,378 | A | | 10/1996 | Tiphonnet | 132/325 |
| 5,573,021 | A | | 11/1996 | Grofcisk | 132/324 |
| 5,823,207 | A | | 10/1998 | Bushman | 132/323 |
| 5,878,759 | A | | 3/1999 | Arias | 132/325 |
| 6,105,585 | A | | 8/2000 | Thomas | 132/217 |

* cited by examiner

*Primary Examiner*—Todd E. Manahan
(74) *Attorney, Agent, or Firm*—Peter M. Giancana; Martin W. Haerter, Esq.; Karen A. Lowney, Esq.

(57) ABSTRACT

The present invention is an eyeliner applicator and method of using the applicator. The applicator comprises two arms, each arm having a proximal and a distal end. The proximal ends of the arms are supported such that the distal ends of the arms are maintained in a spaced apart relationship. An applicator surface extends from the distal end of one arm to the distal end of the other arm. The proximal ends of the arms may be connected directly to each other or to an intermediary member. Optionally, a handle may depend from the arms or the intermediary member. Optionally, the applicator surface is treated in any of various ways to enhance its functioning. Optionally, a stabilizing member is provided for bracing the applicator against the body during application. Optionally, a supply of applicator surface material is provided to allow the applicator surface to be replaced between applications.

33 Claims, 9 Drawing Sheets

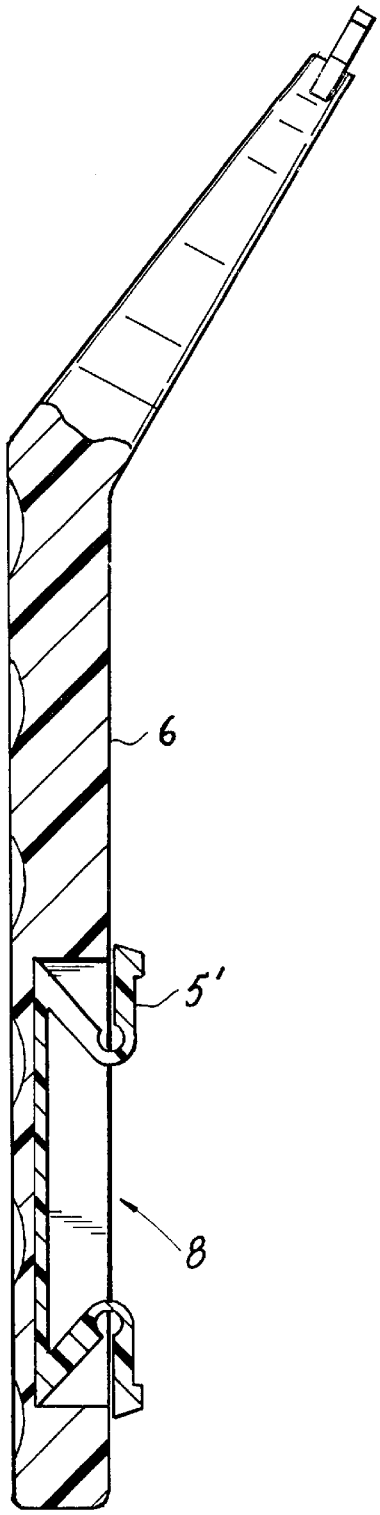
Figure 11
Figure 12
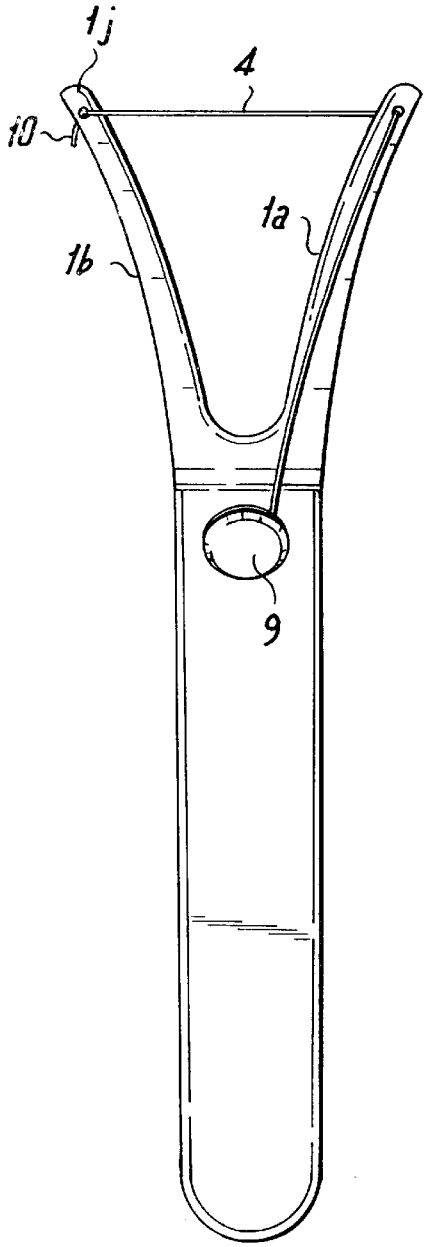

EYELINER APPLICATOR

FIELD OF THE INVENTION

The present invention is a cosmetics applicator and its method of use. More specifically it is an applicator for eyeliner that enables quick, straight and even application of eyeliner.

BACKGROUND OF THE INVENTION

Eyeliner cosmetics are applied above and below the eye to adorn the face through the use of highlighting, accenting and color. The most common methods of applying eyeliner include drawing it onto the eyelid with a pencil-type eyeliner and brushing it on with a specially designed brush. These methods have several disadvantages which are addressed by the present invention.

A conventional applicator requires the user to apply lateral pressure to draw the applicator across the surface of the eyelid, while also applying pressure downward to deposit product on the eyelid. In the process, the soft eyelid is prone to fold or bunch up in front of the applicator. This leads to a messy, inconsistent application of eyeliner.

With a conventional applicator, the hand of the user must remain unnaturally steady while applying the eyeliner across the irregular and contoured surface of the eyelid. If the hand is not steady the result will be a crooked application of eyeliner that is unevenly deposited. The hand of the consumer may be unsteady for several reasons. Firstly, there is a natural amount of tension in the hands and arms. This tension produces a shaking motion, particularly in the elderly, that makes it difficult to achieve the precision needed for an even and straight application of eyeliner. Secondly, some applicators, like the pencil-type, contact the eyelid at one point only. This means that the pencil is free to pivot in all directions leading to instability during application. The degree of unsteadiness in the hands of some consumers, the elderly for example, may be sufficient to prohibit them from using a conventional eyeliner applicator.

Another source of unsteadiness when using conventional eyeliner applicators is that they are not ergonomically designed for the task of eyeliner application. Here "ergonomic" includes any feature that relieves strain and promotes steadiness in the hand of the user. An ordinary writing pencil is optimally used with the writing hand and pencil resting on a flat, smooth and supported surface, out and away from the eye, with considerable pressure applied to the writing surface. In contrast, a pencil eyeliner is used without any support for the hand and arm which must be held in an elevated position. This causes muscular strain in the hand and arm of the user that is not normally present when using a pencil. This causes the user to be uncertain and the results to be inferior.

One way to correct this inferior application of the eyeliner is to go over the area again and again to fix it up. However, this has the disadvantage of depositing more eyeliner onto the eyelid than is necessary to create the desired effect. Repeated applications make it impossible to achieve a thin, fine line of product, when this is what is desired. Some parts of the application will inevitably be thicker than other parts. Product will be wasted and less value for the money received by the consumer. Repeated strokes will give an uneven appearance, especially if a brush-type applicator is used. A brush may splay causing an irregular line across the eyelid. Brush type applicators accumulate product on the bristles that is not easily removed. Hardened accumulation on the brush inhibits the functioning of the brush, resulting in an inferior application of eyeliner.

A pencil-type applicator must be sharpened periodically because the point becomes dull and this leads to an inferior application of eyeliner. Sharpening the eyeliner pencil has some drawbacks. Firstly, it is difficult to sharpen just the right amount, so that the point is sufficiently narrow, but not so narrow as to be weak and prone to fracture. Also, with a pencil-type eyeliner, the consumer is required to have a pencil sharpener. The applicator is really two parts rather than just one. If the sharpener is misplaced, the pencil may not be usable.

The cost associated with brush and pencil-type applicators makes them unsuitable for trial use at the cosmetics counter, where the applicator would be disposed after one use. Also, the amount of consumer waste associated with such a one-time trial program is very large. On the other hand, reusing a brush or pencil type applicator on different people is unsanitary. What is needed in this situation is an applicator that can be used on different people while being sanitary, with minimal consumer waste after each application.

Devices having a thread or wire supported between spaced apart arms are known. See for example U.S. Pat. No. 3,908,678, which describes, " . . . a fork-like implement having two tines on teeth between which dental floss is held in a taut condition." Many variations of the basic design of the '678 patent are available in the prior art. These variations include, but are not limited to a container for holding replacement portions of thread, especially where the thread is capable of being continuously fed into position for use (U.S. Pat. Nos. 3,908,678; 4,691,719; 4,790,336; 5,060,681; 5,560,378; 5,573,021; 5,823,207; 5,858,759). Other variations include manipulating the angle and/or offset between the tines and the handle (U.S. Pat. Nos. 3,908,678; 4,790,336; 5,060,681; 5,246,021; 5,560,378; 5,573,021; 5,823,207; 5,878,759). All of the just named patents, which describe some means for securing the floss thread to or over a pair of tines, is herein incorporated by reference, in its entirety.

In all of these prior art devices, the thread is in a taut condition just prior to use. This gives the floss its scraping or scrubbing ability for which it is intended. However, as explained in U.S. Pat. No. 4,006,750, a taut, inflexible floss minimizes the floss' degree of contact with the curved surface of the tooth. This is because the floss cannot contour to a curved tooth, being inflexible. It stands to reason then, that the inability of these prior art devices to conform to a contoured surface makes them unsuitable for applying makeup to a contoured surface, such as the eyelid. Furthermore, the tautness of the thread of these devices is suitable for contacting hard surfaces such as tooth enamel, but is wholly unsuited for contacting soft, sensitive surfaces such as an eyelid.

On the other hand, in the floss device of U.S. Pat. No. 4,006,750 the floss thread is not taut just prior to use. For at least two reasons a device of this kind is also unsuitable for applying a cosmetic to the eyelid. Firstly, if the thread is slack it cannot efficiently take up product when the thread is brought into contact with the product. Secondly, a slack thread cannot be brought into contact with the eyelid with any significant degree of precision.

Finally, the handle of the prior art devices is generally arranged to be suitable for flossing teeth, but is not necessarily conveniently or ergonomically arranged for applying cosmetic to a contoured surface.

OBJECTS OF THE INVENTION

Based on the foregoing, one object of the present invention is to provide an eyeliner applicator that is easier to use than existing eyeliner applicators.

Another object of the present invention is to provide an eyeliner applicator that gives a better application of eyeliner above and below the eye.

Another object of the present invention is to provide an eyeliner applicator that deposits a straight line of eyeliner of uniform thickness above and below the eye.

Another object of the present invention is to provide a device having a thread supported between spaced apart arms, that is suitable for applying eyeliner above and below the eye.

Another object of the present invention is to provide an eyeliner applicator that requires minimal effort for a complete application.

Another object of the present invention is to provide an eyeliner applicator that is ergonomically designed for the task of eyeliner application.

Another object of the present invention is to provide an eyeliner with a removable, replaceable applicator surface.

Another object of the present invention is to provide an eyeliner applicator that is suitable for a sampling program, as at a cosmetics counter.

SUMMARY OF THE INVENTION

The present invention is an eyeliner applicator and method of using the applicator. The applicator comprises two arms, each arm having a proximal and a distal end. The proximal ends of the arms are supported such that the distal ends of the arms are maintained in a spaced apart relationship. An applicator surface extends from the distal end of one arm to the distal end of the other arm. The proximal ends of the arms may be connected directly to each other or to an intermediary member. Optionally, a handle may depend from the arms or the intermediary member. Optionally, the applicator surface is treated in any of various ways to enhance its functioning. Optionally, a stabilizing member is provided for bracing the applicator against the body during application. Optionally, a supply of applicator surface material is provided to allow the applicator surface to be replaced between applications.

Using the applicator comprises contacting the applicator surface with a cosmetic product, placing the applicator surface on the eyelid with pressure sufficient to flex and/or stretch the applicator surface so that the applicator surface conforms to the contour of the eyelid, and lifting the applicator from the eyelid. In the process, the applicator surface makes contact across at least a portion of the eyelid, and preferably makes contact across the width of the eyelid, conforming to the contour of the width of the eyelid as it does.

BRIEF DESCRIPTION OF THE DRAWINGS

FIG. 11 embodiment of the handle hollowed out to receive extra fillet member.

FIG. 12 embodiment of the handle comprising a spool of strand material.

DETAILED DESCRIPTION OF THE INVENTION

Figure 1:
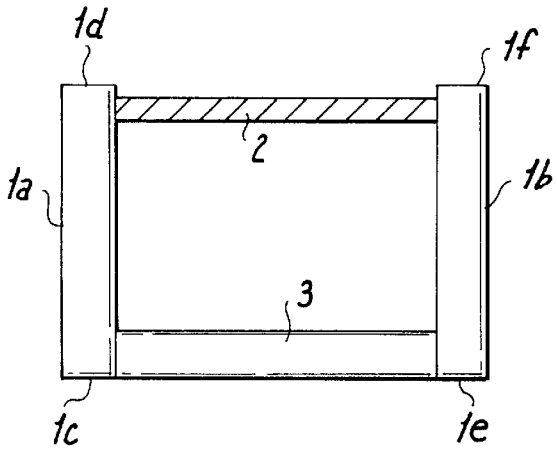
FIG. 1 elevation view showing the spaced apart arms connected through an intermediary member.
Figure 2:
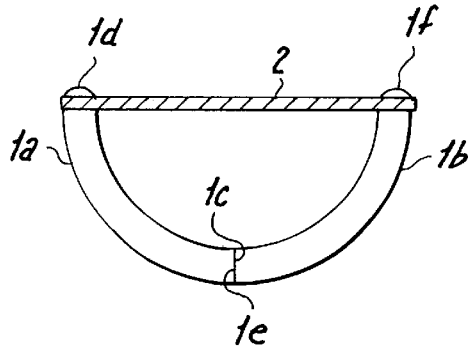
FIG. 2 elevation view showing the spaced apart arms connected to each other directly.

The present invention, shown generally at FIGS. 1 and 2, is an eyeliner applicator and method of using the applicator. The applicator comprises two arms (1*a*,1*b*), each arm having a proximal end (1*c*,1*e*) and a distal end (1*d*,1*f*). The proximal ends of the arms are supported such that the distal ends of the arms are maintained in a spaced apart relationship. An applicator surface (2) extends from the distal end of one arm to the distal end of the other arm. The proximal ends of the arms may be connected directly to each other (FIG. 2) or to an intermediary member (3, FIG. 1). Optionally, a handle (6) may depend from the arms or the intermediary member.

As noted, the proximal ends (1*c*,1*e*) of the arms are connected such that the distal ends (1*d*, 1*f*) are maintained in a spaced apart relationship. The spacing of the distal ends is sufficient to accommodate at least a portion of the curvature of the eyelid between the distal ends. Preferably the arms are integrally molded, but may be fashioned separately and later attached to each other, or to an intermediary member, by any suitable means such as gluing, welding, threaded engagement, snap fitting, friction fitting etc.

An applicator surface (2) is supported by and between the distal ends (1*d*, 1*f*) of the arms. The surface is sufficiently taut so that it does not sag or droop under its own weight when loaded with eyeliner. Furthermore, the applicator surface is sufficiently taut so that it can be precisely positioned in contact with the eyelid. On the other hand, the applicator surface is resiliently flexible, meaning that it can bend or stretch when an external force is applied to it and then return to its initial condition when the force is withdrawn. The applicator surface is sufficiently flexible to permit it to conform to the rounded contour of the eyelid, while being gentle to the eyelid. There are many possible applicator surfaces. In turn, the choice of applicator surface will affect the way in which the surface is supported by the arms. Some non-limiting examples of the applicator surface will now be described in greater detail.

Figure 3:
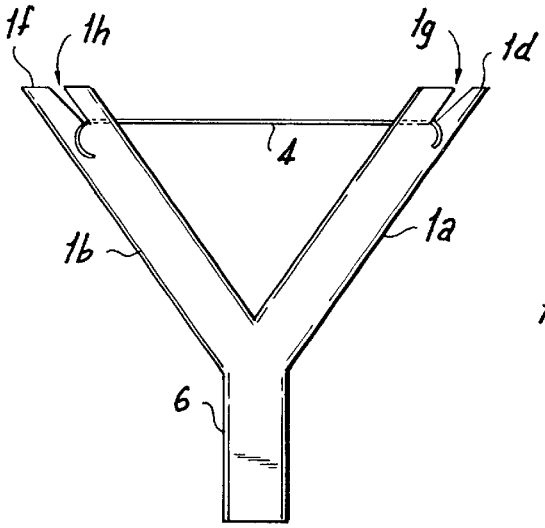
FIG. 3 embodiment showing arms with grooves for receiving a flexible strand.

In FIG. 3 the applicator surface is a flexible strand (4). Examples of this include a thread of natural material (i.e. cotton, silk or wool) or manmade material (i.e. nylon, flexible thermoplastic or elastic cord) or combinations thereof. The strand may be a single fiber or multiple twisted fibers. The flexible strand is secured between the arms (1*a*, 1*b*) such that the strand assumes an initial shape that is free of sagging even when loaded with eyeliner. Preferably, when pressed against the eyelid, the strand will flex and/or stretch sufficiently to allow the applicator surface to conform to the rounded contour of the eyelid, and return to the initial shape when the strand is removed from the eyelid.

Each applicator arm may be provided with at least one receptacle that is capable of receiving the strand, to support the strand. In FIG. 3, the receptacles are grooves (1*g*, 1*h*). The grooves may be dimensioned and configured such that once the strand is wedged into the groove it will not back out of its own accord. One end of the strand may be wedged into the one or more grooves on each arm in such a way that the portion of the strand suspended between the arms is taut. Optionally, a free end of the strand may be wrapped around the arm before or after passing through the one or more grooves, and then knotted so as not to unwrap from the arm. Optionally, the free ends of the strands may be enlarged to further ensure that the ends do not slip through the grooves. Enlarged ends may be achieved by knotting the ends of the strand. Alternatively the enlarged ends may be achieved by providing rivets that are crimped onto the ends of the strand. Alternatively, the strand ends may be coated with a plastic or rubber material to form the enlarged ends.

Figure 4:
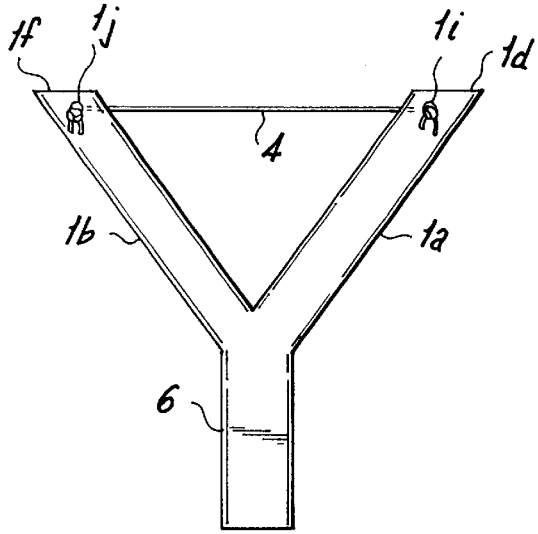
FIG. 4 embodiment showing arms with holes for receiving a flexible strand.

In FIG. 4, the receptacles are holes (1*i*, 1*j*) and the same type of strand (4) shown in FIG. 3 is passed through the holes located in each arm (1*a*, 1*b*). Enlarged ends, as discussed above, are provided on the strand to ensure that the strand does not back out of the holes. Alternatively, at least one post (1*k*, 1*l* in FIG. 5) is provided on each arm around which the free ends of the strand are wrapped. Alternatively, the strand may be more permanently mounted to the arm by gluing, welding, in-molding, etc. Alternatively, any combination of grooves, holes, posts and permanent mounting may be used.

Figure 5:
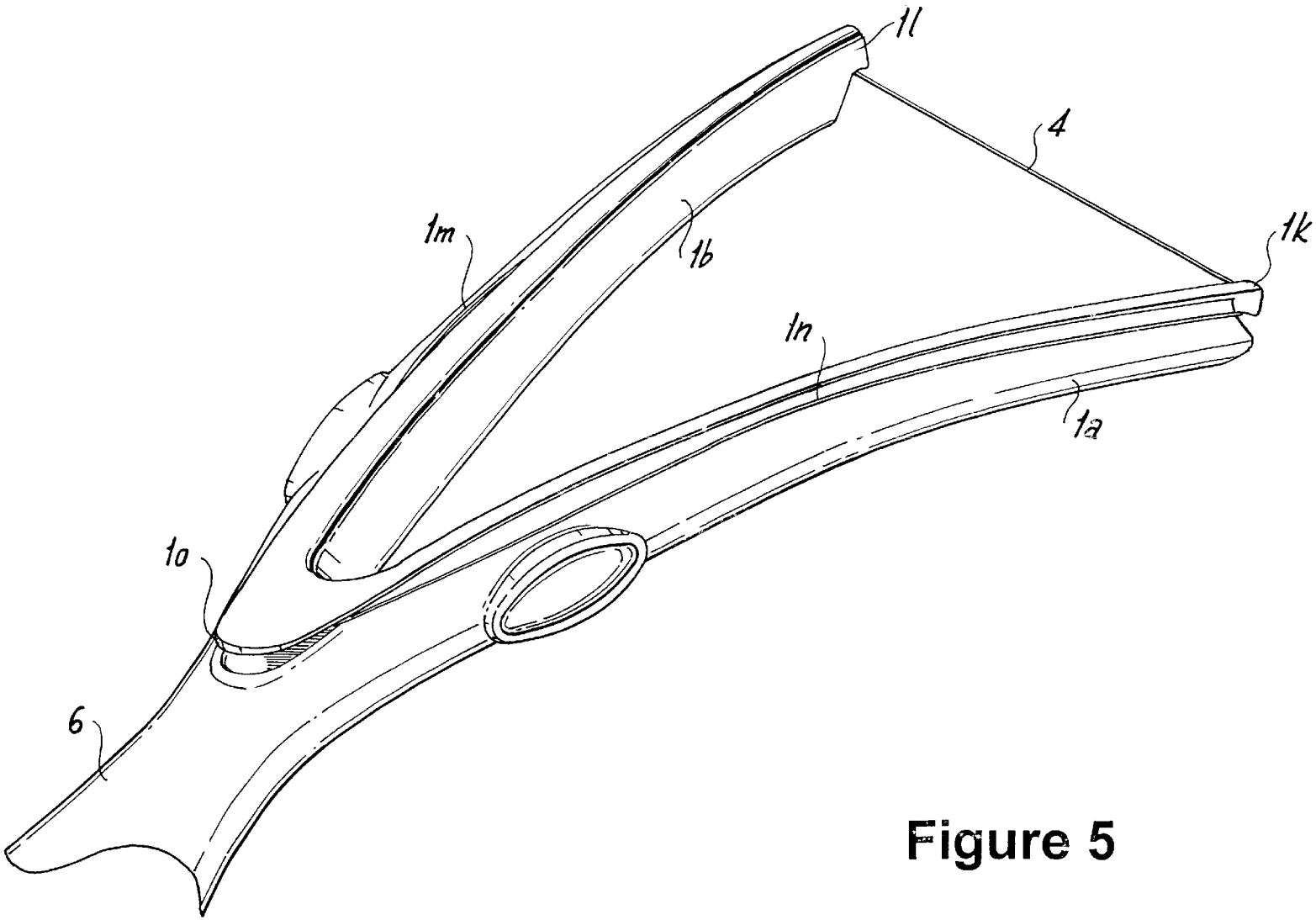
FIG. 5 embodiment showing a closed loop flexible strand as the applicator surface.

FIG. 5 embodies the invention with an axial groove (1*m*, 1*n*) provided along the length of each arm (1*a*, 1*b*). The two grooves meet near the proximal ends (1*c*,1*e*) of the arms. Each groove terminates near the distal ends of the arms where posts (1*k*, 1*l*) extend a short distance from the ends of the arms. Near the proximal ends of the arms, a raised portion (1*o*) is provided. The two posts and the raised portion provide three supports around which the strand (4) may be stretched, the strand itself also lying in the groove. In this design, the strand may be fabricated as a closed loop. The loop is stretched over the posts and raised portion and no knotting nor other fastening is required.

Figure 6:
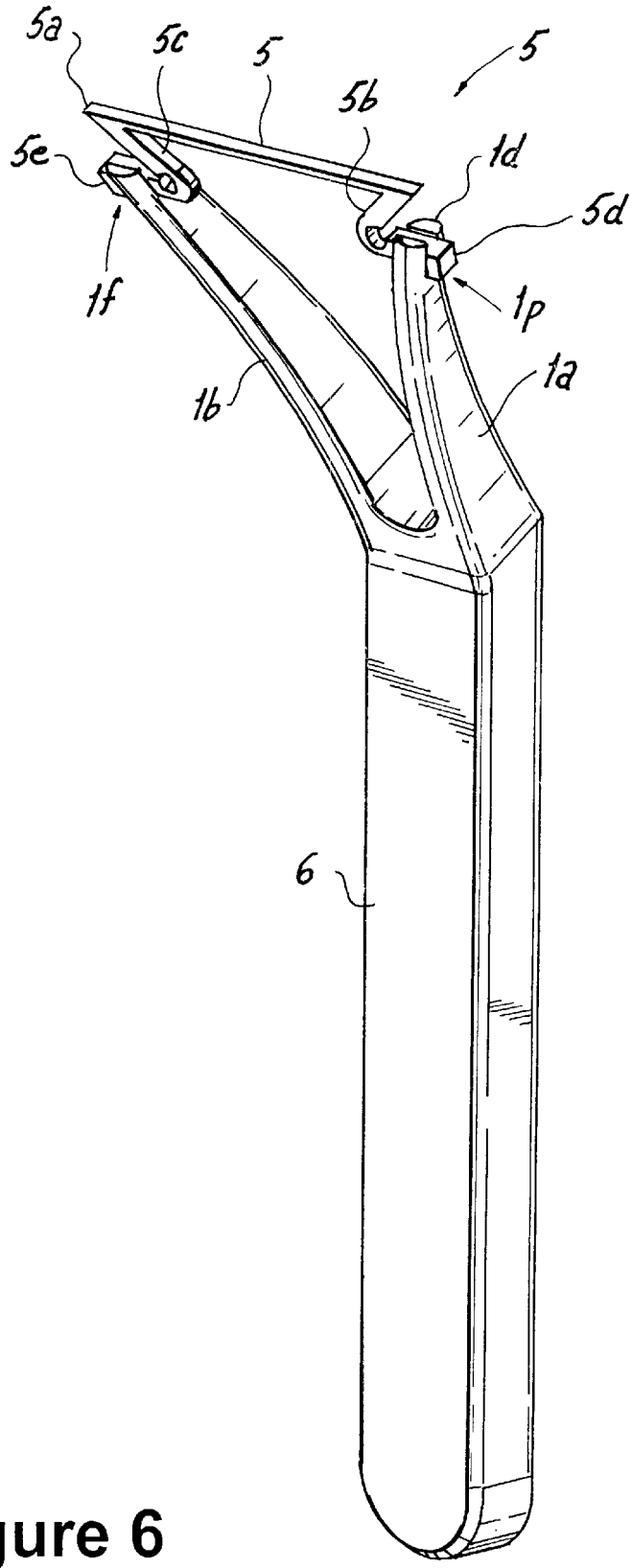
FIG. 6 embodiment showing fillet member with fitments as the applicator surface.
Figure 7:
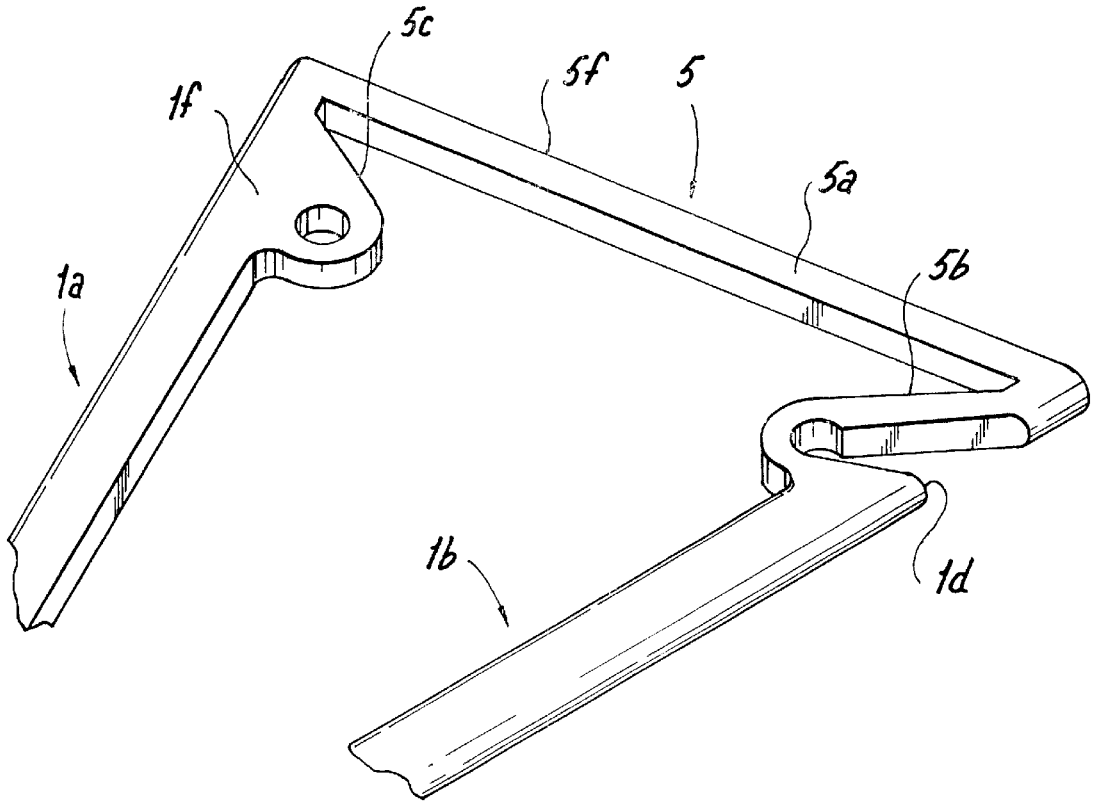
FIG. 7 embodiment showing fillet member integrally molded to the arms as the applicator surface.

In FIGS. 6 and 7, the applicator surface is a fillet member (5) that is flexible, yet more rigid than the strand (4). Here, a fillet member is supported between the arms (1*a*, 1*b*) in such a way that the distal ends (1*d*, 1*f*) of the arms do not extend beyond the fillet member. This arrangement makes it impossible for the ends of the arms to contact the eyelid during application, which if it did happen could leave two concentrated drops of cosmetic at the ends of the eyelid. The fillet member can flex to match the contour of the eyelid and is resilient so that it returns to its original shape when lifted from the eyelid. The member is fashioned from natural or synthetic rubber or flexible thermoplastic.

The fillet member has first and second ends (5*b*, 5*c*) that depend from the main section (5*a*) at an angle, as shown in FIGS. 6 and 7. In the embodiment of FIG. 6 the ends of the fillet member are provided with fitments (5*d*, 5*e*). The distal ends of the arms (1*d*, 1*f*) are provided with slots (1*p*, 1*q*) that are capable of receiving the corresponding portions of the fitments. Once in place, the fitments do not move out of the slots unless sufficient pressure is applied to direct the fitments out of the slots. In this way, the fillet member may be removed from the arms, either for replacing of the member or for cleaning. The member is replaced by snapping the fitments back into the slots. Alternatively, it may be necessary to apply inward pressure to the arms, moving the arms closer together, and then removing or replacing the member. In an alternative embodiment of the fillet applicator surface (FIG. 7), the fillet member is integrally molded with the distal ends (1*d*, 1*f*) of the arms, and no fitments are then needed. Alternatively, the fillet member may be mounted to the arms by any suitable means including, but not limited to gluing, welding, integrally molding, snap and friction fitting.

The main section has a leading edge (5*f*) which is the portion of the applicator surface that is adapted to be loaded with a quantity of product. The leading edge of the fillet member can be made to any suitable shape. For example, the leading edge may be elliptical or square (as shown in FIGS. 6, 7).

Regardless of which applicator surface (2) is used, it will be understood that the amount of product that is picked up and deposited by the applicator surface depends on a number of factors. These include the width of that portion of the applicator surface that is adapted to be loaded with a quantity of product. In the strand type applicator surface, this width is the diameter of the strand (4). In the fillet type applicator surface it is the width of the leading edge (5*f*). The width of that portion of the applicator surface that is adapted to be loaded with a quantity of product is preferably between 0.25 mm to 2.00 mm and more preferably it is between 0.75 mm to 1.50 mm. Dimensions larger than this have been found to give an application that is greater than that normally desired. Dimensions smaller than this become increasingly difficult to manufacture.

The ability of the applicator surface to take up product and deposit it on an eyelid may also be affected by the finish of the applicator surface. For example, the surface may be flocked in such a way and with a certain material that is suitable for picking up more or less product. The applicator surface may be coated or treated with materials that reduce loading capacity but enhance release of cosmetic, for example, wax or oil. The finish may be smooth or rough. These and other factors that affect the performance of the applicator surface to take up and deposit product are herein contemplated. Finally, the characteristics of the eyeliner product itself will affect the ability of the applicator surface to take up product and deposit it on an eyelid. It will be understood that these factors can be combined and varied to arrive at the desired applicator characteristics.

Optionally, the applicator comprises a handle (6). The handle of the applicator is, preferably, an elongated member that allows the user to maneuver the applicator surface (2) into position on the eyelid. The handle is, preferably, designed for one-handed use. Preferably, the handle promotes confidence in the user's ability to perform the delicate task of applying eyeliner. This is achieved by designing the handle according to well known ergonomic principles. Here "ergonomic" includes any feature that relieves strain and promotes steadiness in the hand of the user when the user grips the handle. Some features of an ergonomically designed handle may include the following. The shape of the handle may be such that the handle does not easily rotate between the palm and fingers. The handle may be contoured to provide a space for some or all of the fingers of the user, who will thus consistently grip the handle the same way during every use. The handle may be covered with any of soft grip material used for writing implements, such as a rubber overlay, a bi-injection molded layer, a so-called soft-touch material, or a gel-containing skin.

Figure 8:
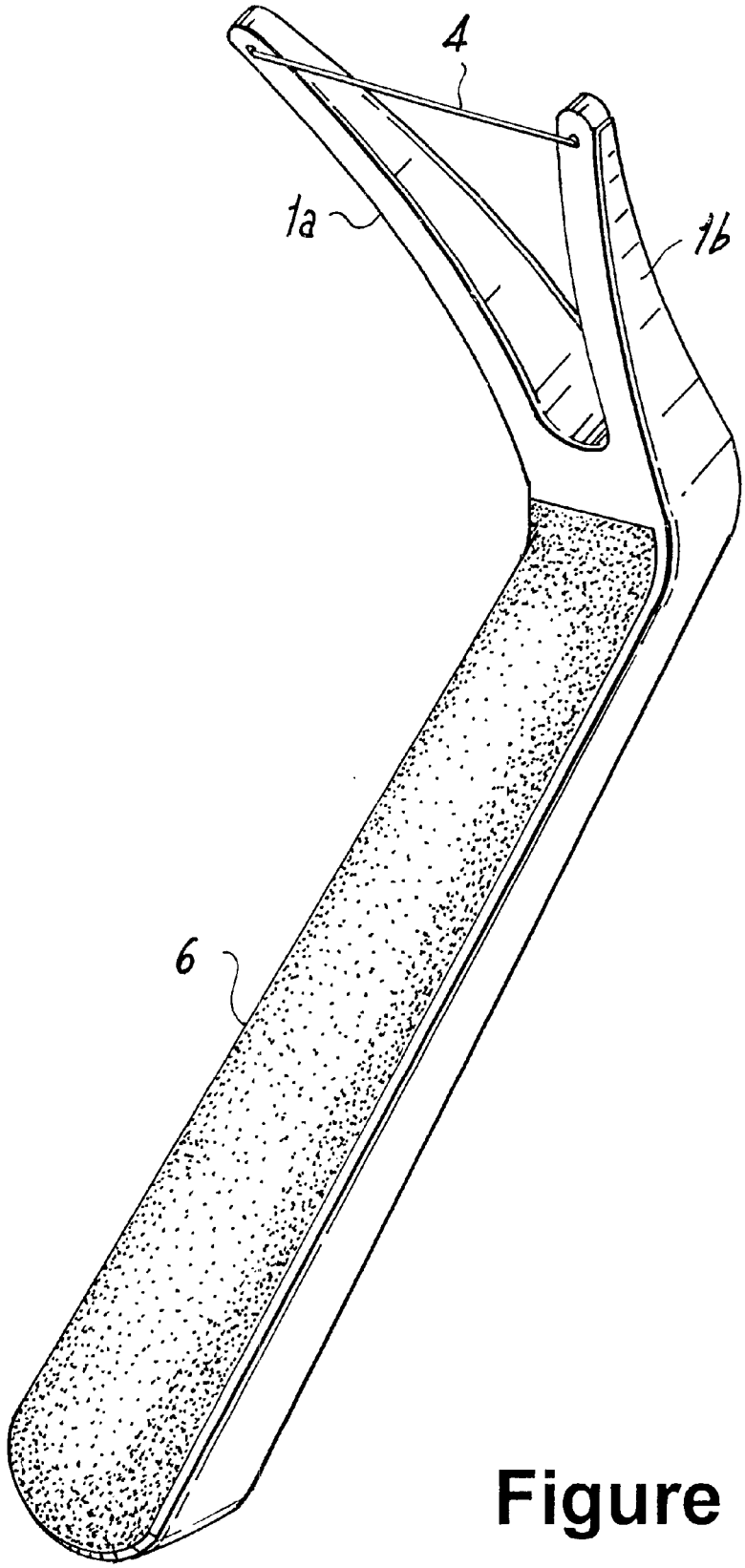
FIG. 8 elevation view showing the spaced apart arms at an angle to the handle.
Figure 9:
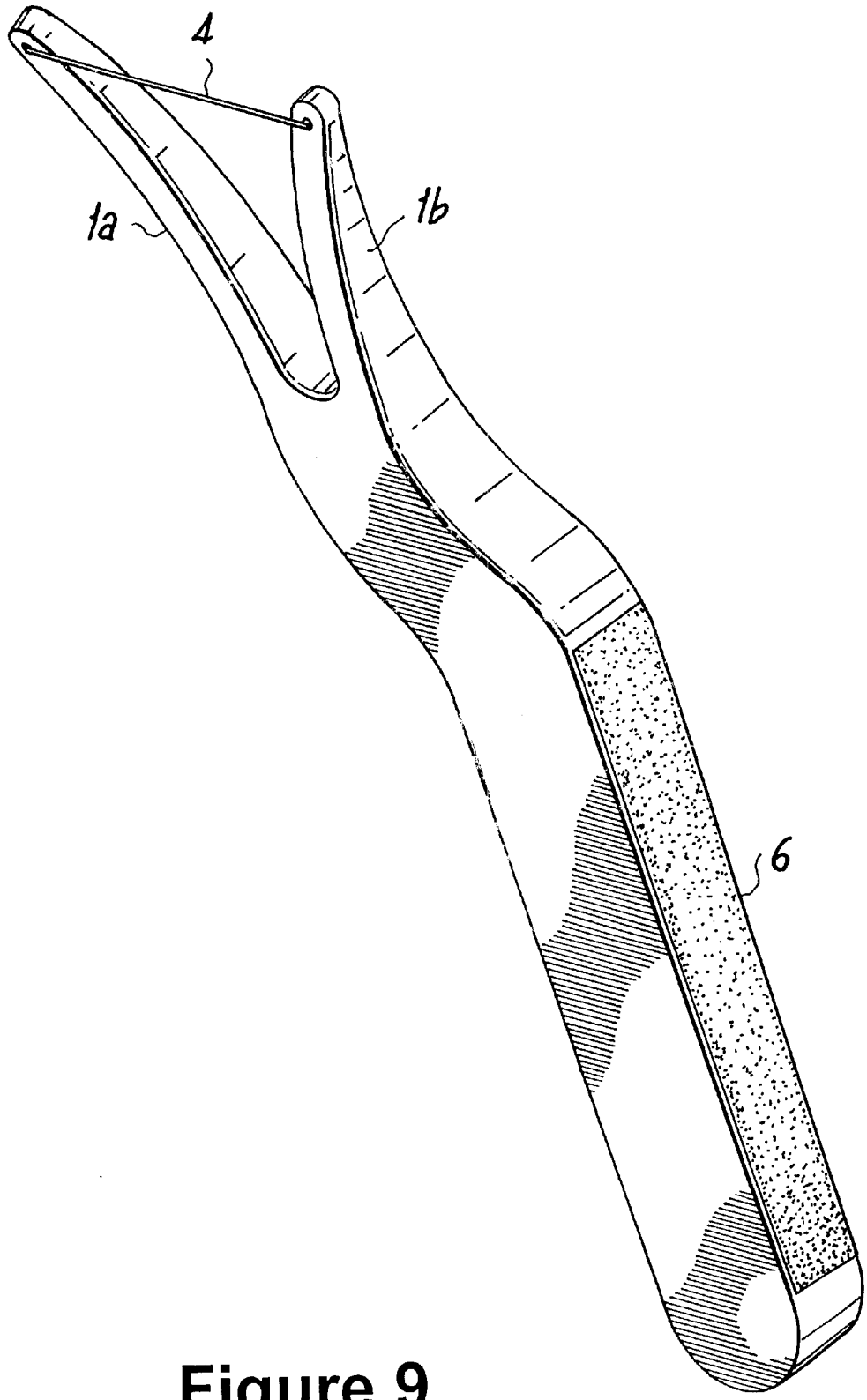
FIG. 9 elevation view showing the spaced apart arms offset from the handle.

If included, the handle (6) preferably depends from the arms (1*a*, 1*b*) or from the intermediary member (3). The handle may attach to one or more arms near the proximal ends (1*c*, 1*e*) of the arms, near the distal ends (1*d*, 1*f*) of the arms, or anywhere in between. The handle may attach to the intermediary member. The arms and the handle may lie in a single plane or the arms may be angled (FIG. 8) and/or offset (FIG. 9) relative to a longitudinal axis drawn through the handle. Preferably, the arms are angled. This makes for easier application because the hand of the user will be further away from the face, giving more room to maneuver while also providing the user with an unobstructed view during application. Preferably the handle is molded in rigid plastic such as polyethylene, polypropylene, polycarbonate, polystyrene, polyvinyl chloride, polyethylene terephthalate, acrylonitrile-butadiene styrene. Any other suitable plastic may be used, the suitability being readily determined by one skilled in the art. The handle may also be constructed of metal, such as stainless steel or aluminum. Preferably the handle and arms are integrally molded, but may be fashioned separately and later attached to each other directly, or through an intermediary member, by any suitable means such as gluing, welding, threaded engagement, snap fitting, friction fitting etc.

Figure 10:
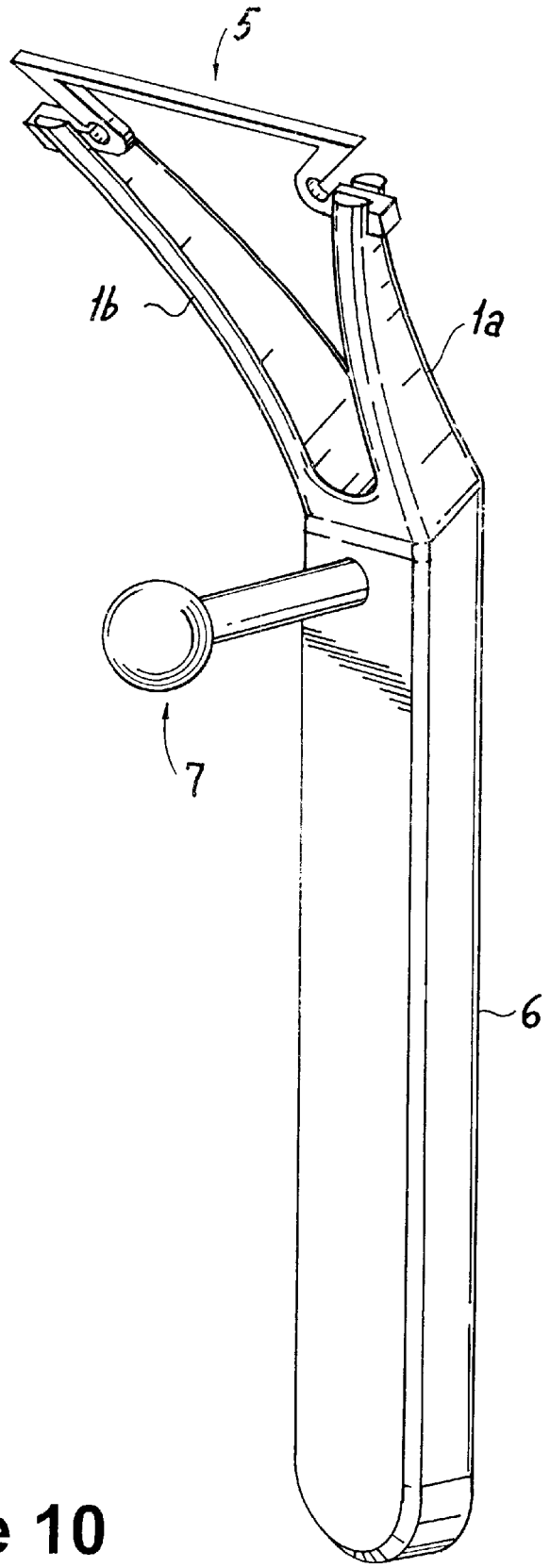
FIG. 10 embodiment of the handle with optional stabilizing member.

Optionally, a stabilizing piece (7 in FIG. 10) adapted to contact the users face may depend from the handle (6) or the arms (1*a,* 1*b*). With the stabilizing piece resting on the users cheek, the steadiness of the applicator is increased substantially. The applicator can then be balanced on the stabilizing piece to rotate the applicator surface onto the eyelid.

Optionally, the applicator may be capable of accommodating one or more lengths of extra applicator surface material (i.e. an extra length of strand (4') or extra fillet members (5')). For example, the handle (6) may comprise a hollow (8 in FIG. 11) that is capable of receiving an extra fillet member (5'). Or, a rotatable spool (9 in FIG. 12) of the strand may be housed in the handle or attached to the outside, either on the handle or one of the arms (1*a,* 1*b*). In this embodiment the free end (10) of the spooled strand is pulled, to position fresh strand between the arms. The free end of the spooled strand runs from the supply spool to the first arm (1*a*) and then to the second arm (1*b*). The free end is secured by any of several means. For example, there may be a slot cut into the second arm into which the strand is wedged, a portion of the slot being narrower than the strand or the strand may be knotted so that it cannot slip out of the hole (1*j*) in the second arm. The excess, used strand may then be cut off. Alternatively, a stationary post (not shown) may be located anywhere on the applicator that is convenient. The free end of the strand can then be wound several times around the post. Alternatively, a second rotatable post (a take-up post) can be attached to the outside of the applicator. When the take-up post is rotated, the used strand is collected on the take-up post and simultaneously, fresh strand is positioned between the arms. When the supply spool is used up, it may be replaced if suitable provision for that has been made. Otherwise the applicator is thrown away.

The applicator of the present invention can work with various product types, for example creams, lotions, powders, pastes, liquids, gels and emulsions of wide ranging viscosity. The applicator of the present invention may be used to apply conventional eyeliner products, but has also been found to work well with products of higher viscosity, i.e. semi-solids. The advantage of this is that the field of eyeliner formulations is expanded to include formulations that were previously unsuitable for conventional applicators. Cosmetic ingredients in quantities that were previously considered to make a formulation too viscous may now be considered suitable for the consumer, made possible by the applicator of the present invention.

The applicator surface may be supplied to the consumer pre-impregnated with product. Generally, this would mean that the applicator had a limited number of uses unless a supply of product was also provided. This situation might be used, for example, in a promotional, free samples program. Alternatively, a number of pre-impregnated applicator surfaces may be supplied with the applicator. The number of surfaces supplied will determine the number of uses that the consumer will have. Also, each applicator surface may be loaded with the same or different product. For example, different color shades may be sold in a single kit. After each use the applicator surface is removed, discarded and replaced, as discussed above.

When the same applicator surface (2) is to be reused several times, then a supply of product is needed to load the applicator surface. The packaging of the product supply may be conventional or may be designed specifically for the applicator of the present invention. Conventional packaging may include a container with an access opening capable of receiving the applicator surface mounted on the spaced apart arms (1*a,* 1*b*) of the applicator. The applicator surface is immersed in product and removed from the jar. In this scenario a separate wiping function may be needed to remove excess product from the applicator and to provide for a clean application of product to the eyelid.

Figure 13:
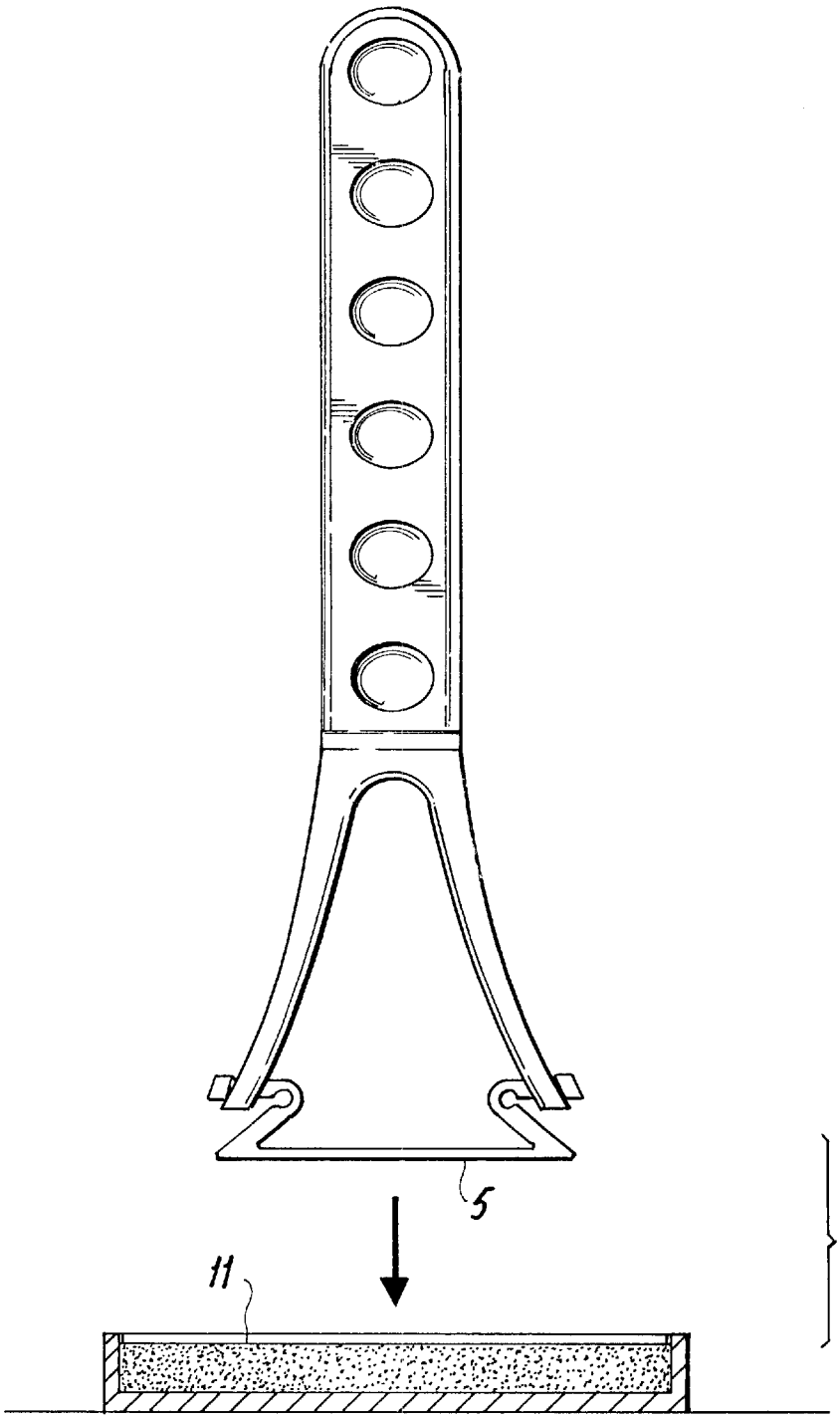
FIG. 13 depiction of fillet member applicator surface contacting eyeliner stamp pad.

A less conventional approach would be to provide a stamp pad (11 in FIG. 13) in an airtight container. The stamp pad is impregnated with product before giving it to the consumer. In use, the applicator surface (5) is brought into contact with the stamp pad. The applicator surface may be pressed against the pad or drawn across it. In this way, product is taken up by the applicator for depositing on the eyelids.

Advantageously, one applicator of the present invention may be used by different people in a sanitary manner, as at a cosmetics counter for sampling. Or the applicator may be used by the same person to try different products or different colors of the same product. Preferably, in this situation, the applicator will have a removable or replaceable applicator surface (2). After one use, the applicator surface can be replaced, as discussed above, and is ready for use with a different product or by another consumer. Only with great difficulty and significant effort could a brush-type applicator or a pencil be sufficiently cleaned after contamination so as to be suitable for use again as a sampler. Throwing the brush or pencil away after a single use is both cost prohibitive and ecologically unsound. On the other hand, the waste associated with the present method is minimal, since only the contaminated applicator surface is disposed.

The invention, and its broader aspects, is not limited to the specific details shown and described. Rather, various modifications will be suggested to one skilled in the art, all of which are within the scope of this invention.

What is claimed is:

1. An applicator for applying eyeliner, the applicator comprising:

arms having proximal and distal ends, the proximal ends being connected such that the distal ends are maintained in a spaced apart relationship, the spacing being sufficient to accommodate at least a first portion of the curvature of the eyelid; and a flexible applicator surface that extends from the distal end of one arm to the distal end of the other arm, a portion of the applicator surface being adapted to be loaded with a quantity of eyeliner.

2. The applicator according to claim 1 wherein the portion of the applicator surface adapted to being loaded with a quantity of eyeliner has a width between 0.75 to 10.50 mm.

3. The applicator according to claim 1 wherein the applicator surface is a flexible strand.

4. The applicator according to claim 3 wherein the strand is a thread of natural or manmade material.

5. The applicator according to claim 4 wherein the thread is made from at least one of cotton silk, wool, nylon, flexible thermoplastic or elastic cord.

6. The applicator according to claim 3 wherein at least one of the arms has a receptacle for receiving the strand.

7. The applicator according to claim 6 wherein the receptacle is a groove or hole.

8. The applicator according to claim 7 wherein the strand has ends, at least one of the ends being enlarged.

9. The applicator according to claim 3 wherein at least one post is provided on the distal end, of each arm around which the strand is wrapped.

10. The applicator according to claim 3 wherein the strand is mounted to the arms by gluing, welding or in-molding.

11. The applicator according to claim 3 further comprising an axial groove along the length of each arm, posts extending a short distance from the distal ends of the arms, and a raised portion located near the proximal ends of the arms such that the posts and the raised portion provided supports around which the strand may be stretched, the strand itself also lying in the groove.

12. The applicator according to claim 11 wherein the strand is a continuous loop.

13. The applicator according to claim 1 wherein the applicator surface is an elongated fillet member with first and second ends.

14. The applicator according to claim 13 wherein the fillet member has a fitment near each of the first and second ends.

15. The applicator according to claim 14 wherein the arms each have a slot that is adapted to receive the fitments of the fillet member, such that the fitments cannot move out of the slots unless sufficient pressure is applied to direct the fitments out of the slots.

16. The applicator according to claim 13 wherein the fillet member is mounted to the arms by gluing, welding, integrally molding, snap fitting or friction fitting.

17. The applicator according to claim 13 wherein the fillet member is made of rubber or flexible thermoplastic.

18. The applicator according to claim 1 wherein the applicator surface has a smooth or rough finish.

19. The applicator according to claim 18 wherein the applicator surface is flocked.

20. The applicator according to claim 1 further comprising a handle that depends from at least one arm.

21. The applicator according to claim 20 wherein the handle is contoured to provide a space for individual fingers of a user who grips the handle.

22. The applicator according to claim 20 wherein the handle is covered with a soft grip, the soft grip being a rubber overlay, a bi-injection molded layer, a soft-touch material or a gel-containing skin.

23. The applicator according to claim 20 wherein the arms are angled relative to a longitudinal axis drawn through the handle.

24. The applicator according to claim 1 wherein a stabilizing member depends from the applicator, the stabilizing member being adapted to contact the face of a user when the user applies eyeliner to the eyelid.

25. The applicator according to claim 20 further comprising one or more lengths of applicator surface material.

26. The applicator according to claim 25 wherein the one or more lengths of applicator surface material comprise a spool of strand housed in the handle or attached to the outside of the applicator.

27. The applicator according to claim 25 wherein the one or more lengths of applicator surface material comprise a fillet member that is housed in a hollow located in the handle.

28. An eyeliner applicator system comprising:

arms having proximal and distal ends, the proximal ends being connected such that the distal ends are maintained in a spaced apart relationship, the spacing being sufficient to accommodate at least a first portion of the curvature of the eyelid;

an applicator surface that extends from the distal end of one arm to the distal end of the other arm, a portion of the applicator surface being adapted to be loaded with a quantity of eyeliner; and a supply of eyeliner product.

29. The eyeliner applicator system of claim 28 wherein the eyeliner product is selected from the group consisting of creams, lotions, powders, pastes, liquids, gels, and emulsions.

30. The eyeliner applicator system of claim 29 wherein the supply of eyeliner product is a pre-impregnated stamp pad.

31. The eyeliner applicator system of claim 29 wherein the supply of eyeliner product is a container of eyeliner product, the container having an access opening capable of receiving the applicator surface of the applicator.

32. The eyeliner applicator system of claim 29 wherein the supply of eyeliner product is a pre-impregnated applicator surface.

33. A method of applying eyeliner to the eyelids with an applicator, the applicator comprising arms having proximal and distal ends, the proximal ends being connected such that the distal ends are maintained in a spaced apart relationship, the spacing being sufficient to accommodate at least a first portion of the curvature of the eyelid, and a flexible applicator surface that extends from the distal end of one arm to the distal end of the other arm, a portion of the applicator surface being adapted to be loaded with a quantity of eyeliner, the method comprising the steps of:

(a) contacting the applicator surface with a cosmetic product; and (b) placing the applicator surface on the eyelid with pressure sufficient to flex the applicator surface so that the applicator surface conforms to the contour of the eyelid.

* * * * *